United States Patent [19]

Cseh

[11] 4,225,436

[45] Sep. 30, 1980

[54] APPARATUS FOR SWIMMING POOL WATER SURFACE CLEANING

[76] Inventor: Laszlo Cseh, 5 Merritt Dr., Schenectady, N.Y. 12306

[21] Appl. No.: 877,681

[22] Filed: Feb. 14, 1978

[51] Int. Cl.[2] ..... E04H 3/16

[52] U.S. Cl. ..... 210/169; 210/242 R

[58] Field of Search ..... 210/169, 242 R; 4/172.15, 172.17; 248/274, 300, 207, 424, 514, 535

[56] References Cited

U.S. PATENT DOCUMENTS

| | | | |
|---|---|---|---|
| 1,276,496 | 8/1918 | Crosley, Jr. | 248/300 |
| 1,790,803 | 2/1931 | Francis | 248/300 |
| 3,152,076 | 10/1964 | Kreutzer | 210/169 |
| 3,191,898 | 6/1965 | McCullogh | 248/514 |
| 3,244,284 | 4/1966 | Shaffer | 210/242 R |
| 3,730,472 | 5/1973 | Dale | 248/300 |
| 3,774,767 | 11/1973 | Field | 210/169 |
| 4,068,327 | 1/1978 | Heinlein | 4/172.15 |

*Primary Examiner*—Theodore A. Granger

*Attorney, Agent, or Firm*—Paul I. Edelson

[57] ABSTRACT

Apparatus for improving the efficiency of swimming pool skimmers in cleaning the surface of water in swimming pools of particulate debris are disclosed. The apparatus of this invention includes a mounting bracket adapted to be permanently installed at the wall of a swimming pool, in one embodiment at the intake aperture of a swimming pool skimmer, and having therein a slot configured to receive therein an elongate prismatical member. The slot is so configured that when the prismatical member is inserted therein, the prismatical member is held rigidly in the water of the swimming pool at an angle to the wall of the swimming pool and a depth in the water of the swimming pool to substantially increase the rate of capture of the water surface debris by the skimmer. The prismatical member has a height dimension selected to prevent debris from either splashing over the top thereof, or tunneling through laminar flow paths beneath the prismatical member.

3 Claims, 5 Drawing Figures

APPARATUS FOR SWIMMING POOL WATER SURFACE CLEANING

This invention relates to swimming pools. More particularly, this invention relates to apparatus for improving the efficiency of water surface cleaning of swimming pools employing a continuous cleaning mechanism commonly known as a skimmer.

Swimming pools, particularly outdoor swimming pools must be provided with some means for removing foreign objects from the surface of the water in the pool. Debris such as leaves, insects, litter, and other such organic and inorganic debris collects on the surface of the water in the swimming pool. Such foreign objects floating upon the water surface in a swimming pool are objectionable to swimmers, and, particularly in the case of organic debris, if not removed from the surface of the swimming pool water in a reasonably short time, tend to sink, partially decompose, and form an objectionable and potentially hazardous scum on the wall and bottom surfaces of the swimming pool which may be cleaned only with substantial effort.

Accordingly, means have been developed in the swimming pool art for removing debris from the surface of the water in a pool. Such prior art means as are integrated with pool structure fall generally into two classes. The first of these is generally referred to as a splash gutter and comprises an open top channel extending around the wall of a swimming pool having a side wall on the pool interior side of the channel whose height is slightly above the quiescent surface water level in the pool. The activity involved in use of the pool causes wave action within the pool which, in turn, causes small quantities of water from the surface of the pool to splash into the gutter or channel, carrying surface debris with it. Obviously, a splash gutter provides for no cleaning of the pool water surface when the pool is not in use. The other such water surface cleaning means for swimming pools is generally known as the skimmer type. A skimmer system comprises at least one water inlet port and at least one water outlet port in a wall of the swimming pool positioned essentially at the normal water surface level in the pool. The inlet and outlet ports are connected by a pumping device and a filter device, and the water outlet port is frequently positioned at an angle to the wall of the swimming pool as to set up a continuous, generally circular flow of water in the water surface regions of the pool so that surface water, and the debris suspended therein is continuously urged into the skimmer mouth for filtering and recirculation. These two systems, while very useful, are not fully effective to maintain adequate cleanliness of swimming pool water. As a result, the art has developed supplementary cleaning apparatus to enable adequate maintenance of swimming pools. Examples of such supplementary cleaning devices include swimming pool vacuum cleaners, and wall and bottom surface scrubbers. These suplementary cleaning devices are both expensive and inconvenient to use.

This invention has a principal object the provision of a simple and inexpensive structure to be installed in a swimming pool in conjunction with a conventional skimmer to very substantially increase the efficiency of the skimmer apparatus in cleaning the surface water in a swimming pool. Very briefly, this invention includes an elongate prismatical member extending into the water of the swimming pool from the skimmer device, and serving to very substantially increase the effective capture area of the skimmer mouth. The basic principle underlying this invention is known in the art. For example, U.S. Pat. No. 3,152,076 issued Oct. 6, 1964 to W. A. Kreutzer shows a wand positioned at the mouth of a skimmer port and extending into the water of a swimming pool, at the surface thereof, at a angle to the pool wall to aid in sweeping debris on the surface of the pool water into the skimmer mouth. The angular position of Kreutzer's wand in the horizontal plane is maintained by the splined pin whereby Kreutzer's wand is attached to the pool structure. In the vertical plane, Kreutzer's wand is free to move upwardly and and downwardly along the pin as water level in the pool changes. The vertical position of Kreutzer's wand is determined by the floatation of the wand upon the surface of the water.

As is well known in the art, the operation of a skimmer system sets up a generally circular flow of water at the surface of the swimming pool. The velocity of such water circulation is quite slow. Therefore, such flow is strictly laminar. The so-called surface debris to be cleaned from a swimming pool by a skimmer system is typically found both literally on the surface of the water and at depths of an inch or so into the water of the swimming pool. It is further known that a fluid in a laminar flow interacts with an obstruction in its path by a bending of the flow lines around the obstruction. Therefore, if a wand intended to sweep debris into the skimmer mouth has insufficient depth in the water, a significant portion of the debris suspended in the water will be swept beneath the obstruction by the laminar flow of water about the obstruction. This effect substantially reduces the efficiency of prior art devices employing the principle of this invention.

It is accordingly an object of this invention to provide apparatus for substantially increasing the effective capture area of a swimming pool skimmer mouth.

It is another object of this invention to provide such apparatus which is effective to capture substantially all surface debris impinging upon the apparatus, regardless of the depth of such debris in the water, despite the laminar fluid dynamics of the system.

It is another object of this invention to provide such apparatus adapted to be installed directly in the mouth of a skimmer.

Yet another object of this invention is to provide such method and apparatus which is simple and inexpensive to manufacture and simple to use.

Briefly, and in accordance with one embodiment of this invention, a swimming pool having a skimmer mechanism is provided with a mounting device located approximately the skimmer mouth for removably securing an elongate prismatical sweeper member in the water in the pool. The sweeper member is removable from the mounting device, and from the pool, so as to not interfere with use of the pool by swimmers. When the pool is not in use, the sweeper member may be inserted into the mounting device and is maintained at a preselected angular and vertical position in the water of the pool to increase the effective capture area of the skimmer mouth and to insure that debris in the water to a depth of several inches will be captured. Means may be provided to enable the user to select the angle at which the sweeper is maintained.

The novel features of this invention sought to be patented are set forth with particularity in the appended claims. This invention, together with further objects and advantages thereof may be understood from a reading of the following specification and appended claims in view of the accompanying drawings, in which:

Figure 1:
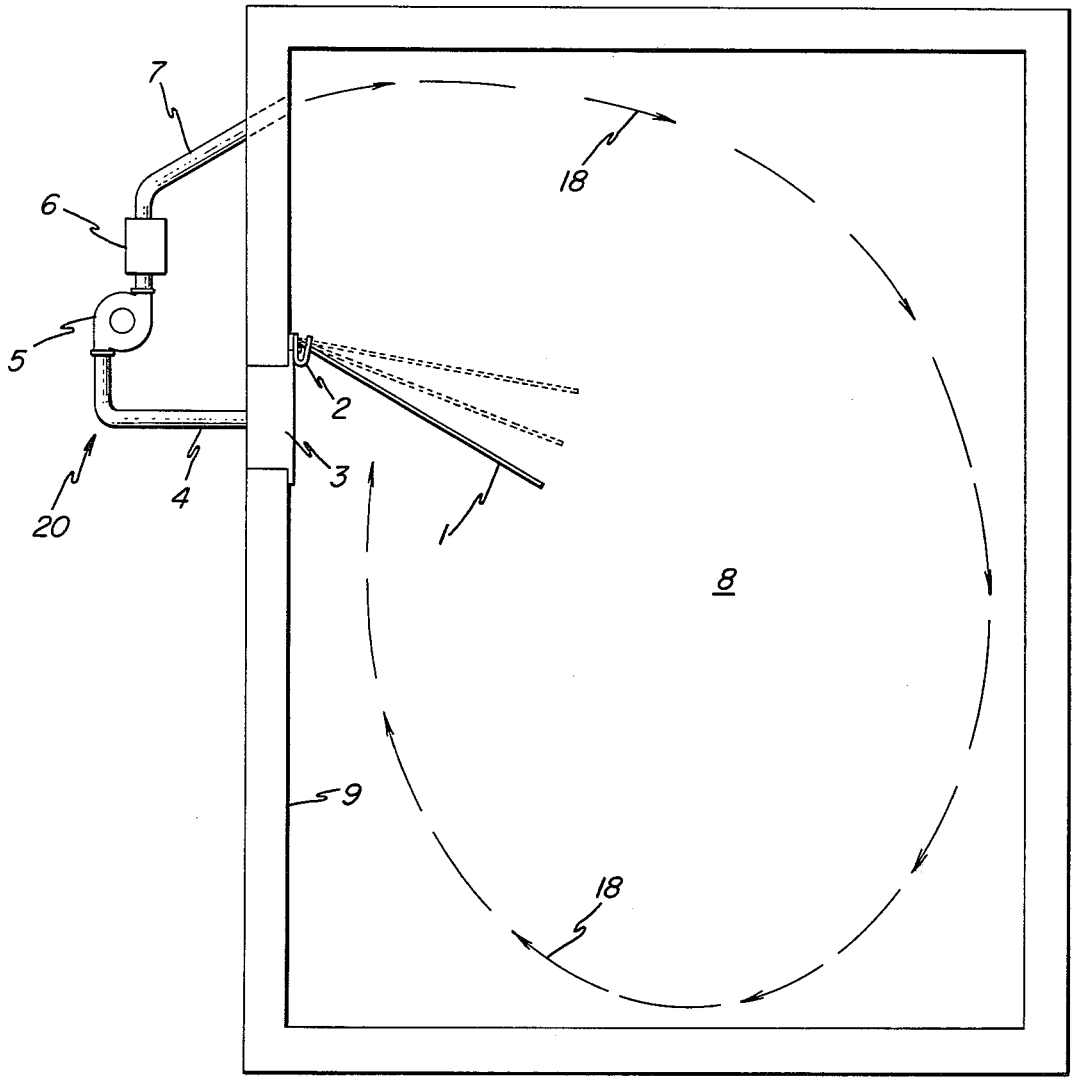
FIG. 1 is a top plan view of swimming pool surface water cleaning apparatus in accordance with this invention installed in a swimming pool having a skimmer, skimmer pump, and filter.
Figure 2:
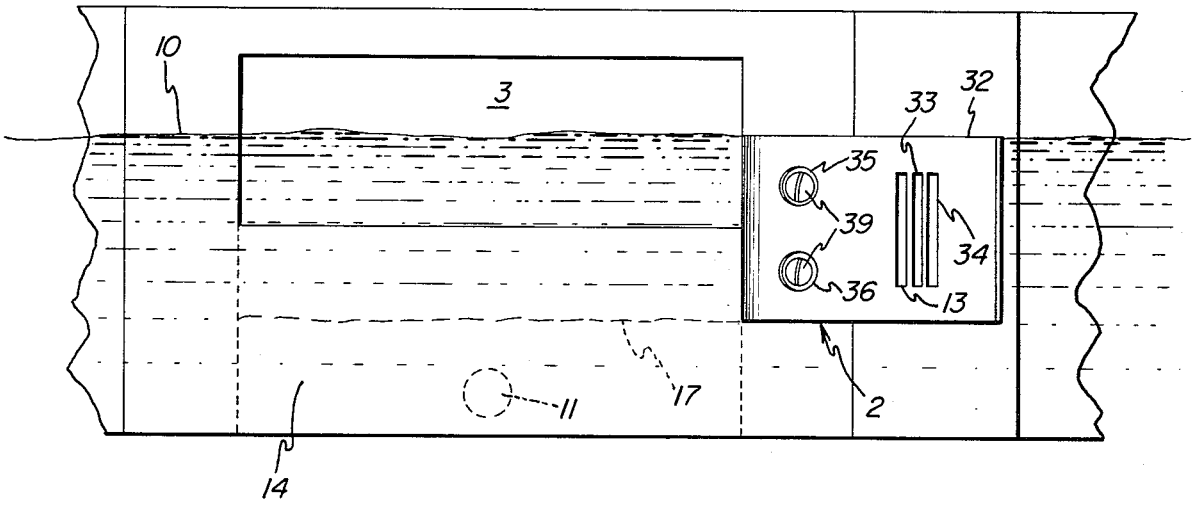
FIG. 2 is a front elevation view of a mounting bracket for the surface water cleaner showing the bracket mounted to the side wall of the skimmer mouth in accordance with one embodiment of this invention.
Figure 3:
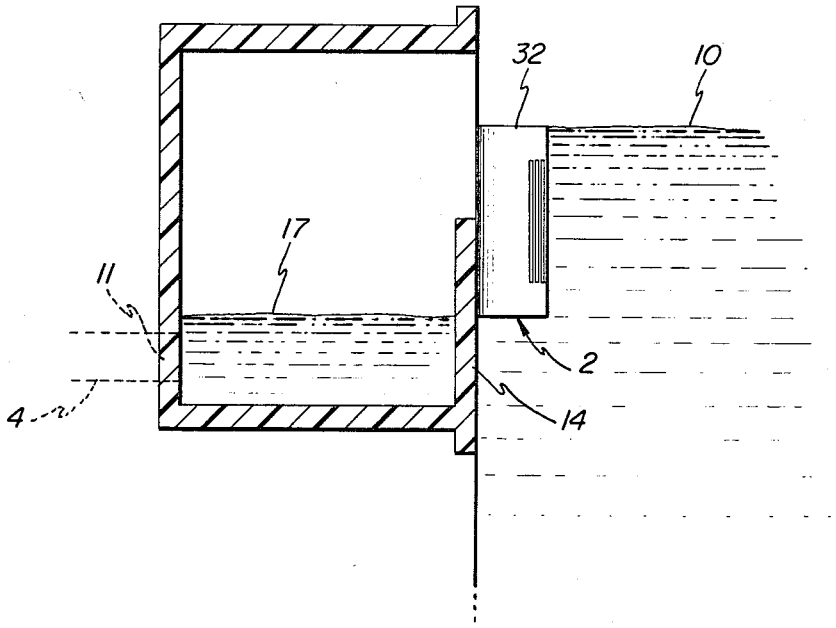
FIG. 3 is a side elevation view of the mounted bracket of FIG. 2.

Referring to FIGS. 1 and 2, in the normal operation of a swimming pool 8, equipped with a skimmer mechanism indicated generally at 20, the skimmer admits water into its trough through the skimmer mouth 3 in the side of the pool. This particulate and debris laden water is sucked through opening 11, located below the nominal water level 17 in the skimmer mouth, through pipe 4, by the action of pump 5. Pump 5 then forces the water through filter 6 which removes the suspended debris. The filtered water is then forced through pipe 7 back into the pool at an angle so as to cause a slow circular flow in the pool as indicated by flow arrow 18.

As a result of the surface water circulation indicated by arrows 18, and the pressure differential between pipes or conduits 4 and 7 maintained by the operation of pump 5, quantities of surface water, with the debris suspended therein, are periodically brought into proximity to the skimmer mouth. Because of the operation of pump 5, a relatively low pressure area is maintained immediately about skimmer mouth 3 and a quantity of water is therefore sucked into the skimmer system and cleaned by the filter as discussed above. In the typical prior art skimmer, however the capture range for floating debris, such as leaves is only several inches, and in some pools the circulation fluid dynamics are such as to cause debris to migrate to the center of the pool. In accordance with this invention, the quantity of water bearing suspended debris delivered to the skimmer mouth and the capture range of the skimmer are increased by providing an elongate prismatical member, or wand, 1 extending into the water of the pool for a length of several feet, and a depth of several inches from the down stream end of skimmer mouth 3, as defined by water circulation flow arrows 18. Prismatical member or wand 1 may be constructed of any suitable rigid, lightweight, material which is resistant to chemical degradation by substances normally present in swimming pools. In an embodiment which has been used experimentally with satisfactory results, member 1 was constructed of a wooden material, but this invention is not so limited, and the prismatical or wand member may be constructed of a plastic foam, hard plastic, or appropriately treated wood or metal, if desired. While the experimental version used a wooden wand member satisfactorily, plastic is the preferred material for its physical and chemical properties. It is also preferred, for convenience in handling, as more fully discussed hereinafter, to so construct member 1 that it is slightly buoyant in the swimming pool water so that it will tend to float when removed from its means for attachment to the pool. The dimensions of the prismatical, or wand, member are not critical, but the height dimension in accordance with this invention must be sufficient to permit the bottom of the wand to extend to a depth of several inches below the nominal water line of water in the pool, and the top of the prismatical member should extend above the nominal water line in the pool for approximately an inch or so; the length dimension of the prismatical member should be as great as possible to maximize the increase of effective capture aperture of the skimmer mouth, constrained only by considerations of convenience of handling in insertion and removal of the wand from the pool; the thickness dimension required is a function of the length and and the material of which the wand is constructed, and need only be sufficient to provide adequate rigidity for the prismatical or wand member in use in a pool. In the embodiment of this invention employed experimentally as discussed above, the prismatical, or wand member 1, comprised a wooden rectangular prismatical member one quarter inch thick, 6 inches high, and 7 feet long. While this invention should be understood as not being limited to any particular dimensions, nor to rectangular prismatical shape for the wand member, this experimental embodiment was found to provide very adequate performance characteristics, and was very convenient to handle in mounting and demounting from the swimming pool.

In operation of the cleaning system of this invention, prismatical or wand member 1 is installed with one end of the wand positioned proximately the down stream end of skimmer mouth 3 and extending into the pool at an angle preselected to maximize the redirection of water and suspended debris therein, circulating in a path indicated by arrows 18, into skimmer mouth 3. The angle between wand 1 and pool wall 9 is selected on the basis of a compromise between the desired maximizing of the velocity of redirected water and debris, and the desired maximizing of the capture range of the wand into the pool. Obviously, the wand will extend to its maximum distance into the pool if it is oriented perpendicularly to the wall; equally obviously, such an orientation would provide for a zero velocity component along the wand to the skimmer mouth, and thus render an inoperative configuration. The narrower the angle between the wand and the wall, the greater the redirection velocity, at the cost of decreased capture range. Additionally, particularly in pools in which the skimmer outlet port and skimmer mouth are located within a few feet of each other, an area of eddy current flow tends to develop down-stream of the wand member. The magnitutide of the area in which an eddy current flow exists is a function of the angle at which the wand is disposed. It is desired to minimize the area of eddy currents, and it has found that by appropriately adjusting the wand angle, it is possible to essentially eliminate eddy currents. Aside from the eddy current factor, the optimum angle between the wand and pool wall is a function of the shape of the pool, and configuration of the skimmer elements within the pool. In experiments conducted in a circular pool, it has been found that the best results are obtained with an angle between the wand and pool wall in the range of 55° to 75°. It is anticipated that the optimum angle in pools of other shapes will also fall within these limits since the flow pattern approaches circular. It is intended merely to indicate that within these limits, the optimim angle will vary from pool to pool. It should also be understood that satisfactory results are obtainable with other than precisely optimum angle.

While for any given pool configuration, there will exist a single optimum angle for the disposition of the wand in the pool, such optimum angle may be ascertained only by tedious experimentation or highly complex calculation in view of the multiplicity of factors involved in determining the optimum angle. It has been found, however, that satisfactory results are obtainable at any angle within the acceptable range of approximately 55 degrees to 75 degrees. If has further been found, that if the apparatus of this invention is so constructed as to provide for the changing of the angle of the wand from a first angle within the range 55 degrees to 75 degrees, to a second angle within the range of 55 to 75 degrees, operational results essentially indistinguishable from those obtained by adjusting the wand angle to the optimum, may be obtained by positioning the wand at the first of such angles within the range of 55 to 75 degrees for a period of time and then adjusting the apparatus so that the wand is maintained at the second of such angles for a further period of time. In this way, that small quantity of debris which may have remained uncaptured with the wand at the first angle will be captured when the wand is positioned at the second angle.

It has also been found, that in the absence of a device in accordance with this invention, debris entering a pool at many positions tends to be collected at the center of the pool, rather than being conveyed to the periphery to be captured by the skimmer.

The apparatus of this invention includes means for maintaining the wand member at the desired angular and depth orientation in the water of the swimming pool during the operation of the cleaning process as heretofore described. The means for positioning the wand member should be located close to the down stream end of the skimmer mouth 3, should provide for the fixing of both the angle and depth of the wand in the pool water during cleaning, and should provide for the simple insertion and removal of the wand member therefrom. Any number of positioning or mounting means for accomplishing this will occur to those skilled in the art. This invention should be understood to encompass any such means for providing the demountable wand positioning function as outlined above. For example, the simplest means might consist of an angle bracket secured to wall 9 of swimming pool 8 adjacent skimmer mouth 3 having an arm into the pool at the desired angle, and wherein the prismatical or wand member has, in one end thereof, a slot configured to mate with the extending arm of the angle bracket. Another such means might comprise a sleeve member configured to closely surroundingly receive one end of the prismatical or wand member against its interior surface, and positioning attachment means such as, for example, brackets attached to its outer surface for attachment to wall 9 or skimmer mouth 3.

Figure 4:
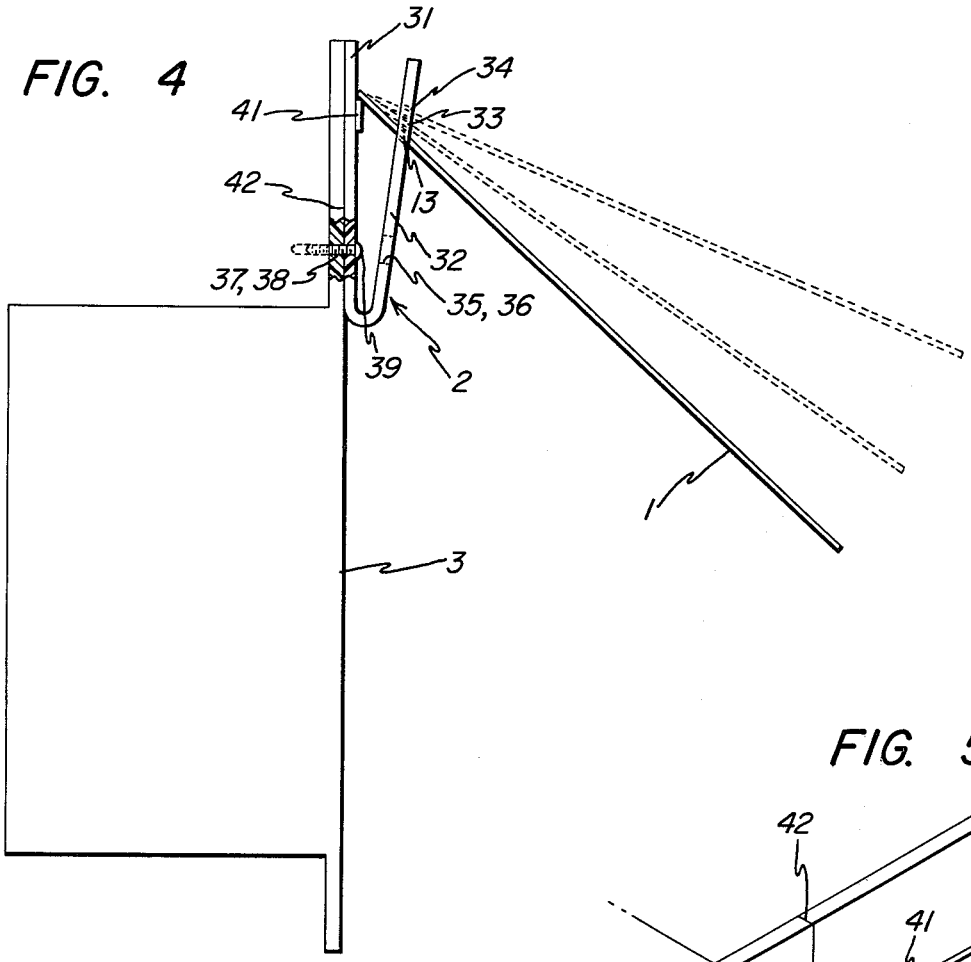
FIG. 4 is an expanded detail top plan view of the apparatus of this invention installed in the pool of FIG. 1 with the wand inserted into the mounting bracket.
Figure 5:
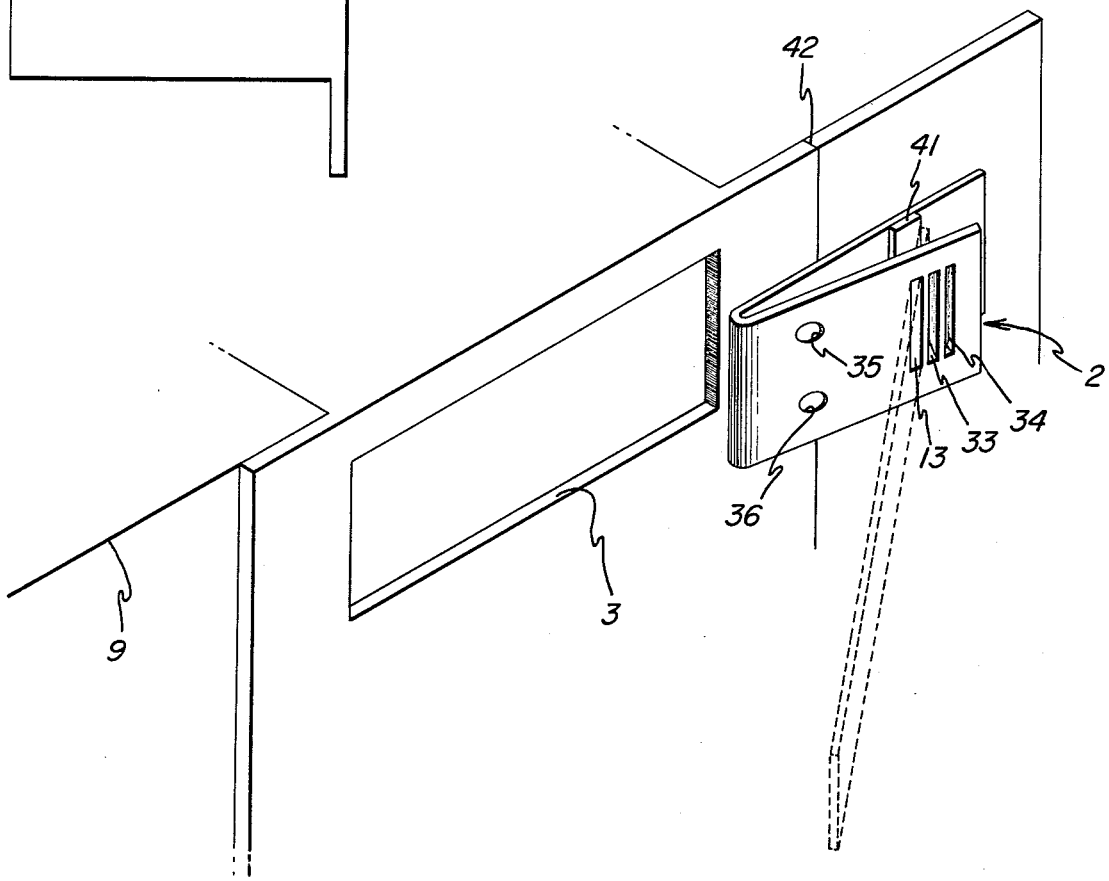
FIG. 5 is an expanded isometric view of the apparatus of this invetion installed in a pool.

The following description of mounting and positioning means in accordance with one embodiment of this invention relates to the means actually employed experimentally with satisfactory results, and most clearly illustrated in FIG. 4, but in view of the foregoing, it should be understood that this embodiment is but one example of such means and the invention as claimed is not so limited. In this embodiment, a mounting bracket 2 is provided for securing and positioning prismatical or wand member 1 during the cleaning operation. Bracket member 2 comprises a quanity of stock material, which is preferrably, and in the embodiment actually reduced to practice a plastic material, having a first portion, 31 adapted to be secured to the wall of the swimming pool at the skimmer bezel, and a second portion 32, bent at an angle to portion 31 and extending into the water of the swimming pool. Portion 32 preferrably contains a plurality of slots, 13, 33, and 34 to provide for the positioning of member 1 at any of the plurality of angles which may be selected. In the preferred embodiment bracket 2 is attached to the pool wall by providing portion 31 of bracket 2 with holes 37 and 38 and portion 32 of bracket 2 with holes 35 and 36. Two of the bolts 39 used for securing the skimmer bezel to the pool wall are removed and replaced with similar but longer bolts. Holes 35 and 36 have a diameter such that the heads of bolts 39 will pass therethrough, and so function merely as access holes. Holes 37 and 38 have a diameter slightly larger than the shank of bolts 39 and smaller than the bolt heads so that the bolts secure the bracket to the wall by action thereagainst. A positioning block 41 is securely attached to portion 31 of Bracket member 2. Block 41 may be fabricated of any convenient material, such as an appropriately noncorrosively treated metal, or plastic. Block 41 may be attached to portion 31 of bracket member 2 by any convenient means, as for example by thermal fusion of plastic members, by a mechanical fastner, by an adhesive, or, in the case of a metalic member, by welding. Block 41 and slot 13 operate cooperatively to determine the angle of wand 1 in the pool. Each of the slots 13, 33, and 34 is dimensioned so as to easily admit the end of wand member 1 at an angle which will cause member 1 to contact portion 31 of bracket 2 slightly downstream of the location of positioning block 41. Once the wand has been inserted into the selected slot and released, the pressure of the circulating water in the pool upon the wand causes the wand to pivot about the downstream edge of the slot until its end contacts block 41. The wand is then securely positioned at an angular orientation in the pool precisely determined by the relative positions of the downstream edges of the slot and block 41. When removal or repositioning of the wand is desired, the pool owner merely exerts a manual upstream pressure on the wand to release it from the securing pressure. The wand may then be easily slipped out and reinserted as described above in another slot defining another wand angle if desired.

In the preferred embodiment, portion of 31 bracket 2 is configured with a step 42 in the surface thereof which is to be positioned against the pool wall. Step 42 is configured to mate with the skimmer bezel so that a nonpivoting, smooth, flat surface will be provided.

The wand 1 is thus inserted through slot 13 in bracket 2 so as to form an angle between the wand and the side of the pool within the range 55° to 75°, on into one of slots 13, 33, or 34 to form such angle at the selection of the user. In addition, the placement of bracket 2 is set so as to insure that wand 1 extends below the surface of the water in the pool by at least 3 inches, and above the water surface by approximately one inch. Thus, suspended particles within the water will be reliably captured and delivered into skimmer mouth 3 at a depth of up to several inches of water and will not be diverted around wand 1 by laminar flow lines interacting with the wand. Further, floating particles will also be reliably captured rather than splashed over the wand as might happen if the top of the wand were too close to the nominal water line 10 in the pool. FIG. 4 shows a detail view of how the wand 1 is inserted into the mounted bracket 2.

When normal swimming use is to be made of the pool, the wand 1 is removed from its slot 13. During idle, nighttime, or other hours when a more efficient cleaning mode is desired, wand 1 can simply be reinserted into slot 13.

The water forced by pump 5 through pipe 7 causes a slow laminar circulation of water in the water surface regions of pool 8. This flow is intercepted by wand 1 which directs the flow, together with surface debris and subsurface debris to a depth of 3–4 inches, toward the skimmer mouth 3. This effectively increases the capture aperture of the skimmer which, without wand 1, would be limited to the length of the lip of skimmer panel 14 over which water flows into the skimmer mouth, and accelerates the rate of delivery of debris laden water to the skimmer. This increase is not only an increase in the surface area capture effect but also includes an increase resulting from subsurface capture resulting from the extension of wand 1 below the nominal water surface level 10. In addition, the capture is not limited to water in the immediate vicinity of the skimmer mouth, but is effectively complete over the entire surface area intercepted by the wand.

While this invention has been described with reference to particular embodiments and examples, other modifications and variations will occur to those skilled in the art, in view of the above teachings. Accordingly, it should be understood that within the scope of the appended claims, the invention may be practiced otherwise than specifically described.

The invention claimed is:

1. In a swimming pool having at least one wall and a skimmer mechanism including a skimmer mouth and a water return port penetrating said wall, said skimmer mouth and water return port being interconnected by conduit and pumping means whereby a generally circular flow of water is maintained in said swimming pool, the improvement which comprises:

an elongate prismatical member;

bracket member mounting means attached to said pool for demountably securing said elongate prismatical member adjacent said skimmer mouth, said member having a first portion attached to said pool wall adjacent said skimmer mouth and a second portion extending horizontally and angularly from said wall into the interior of said pool, block means attached to said first portion of said bracket, a plurality of vertical slots located in said second portion of said bracket member whereby said elongate prismatical member may be positioned at predetermined angular and vertical positions in said pool and an end thereof restrained by said block means.

2. The improvement of claim 1 wherein said block means and said plurality of slots are constructed and arranged to provide angles between said pool wall and said prismatical member within the range of 55 to 75 degrees.

3. The improvement of claim 1 wherein said elongate prismatical member has a heigth dimension of at least four inches.

* * * * *